US007275773B1

(12) United States Patent
Weathersby et al.

(10) Patent No.: US 7,275,773 B1
(45) Date of Patent: Oct. 2, 2007

(54) SIX-WAY LATCH BOLT ASSEMBLY

(75) Inventors: Steven T. Weathersby, Foothill Ranch, CA (US); Robert L. Gast, Foothill Ranch, CA (US)

(73) Assignee: Hampton Products International Corporation, Foothill Ranch, CA (US)

( * ) Notice: Subject to any disclaimer, the term of this patent is extended or adjusted under 35 U.S.C. 154(b) by 0 days.

(21) Appl. No.: 11/644,429

(22) Filed: Dec. 22, 2006

(51) Int. Cl.
*E05B 9/00* (2006.01)
*E05C 1/00* (2006.01)

(52) U.S. Cl. ..... 292/337; 292/1.5; 292/DIG. 53; 292/DIG. 60

(58) Field of Classification Search ..... 292/337, 292/327, DIG. 53, DIG. 64, 1.5, 137, 163, 292/169, DIG. 54; 70/451, 370, 372, 381, 70/448–450
See application file for complete search history.

(56) References Cited

U.S. PATENT DOCUMENTS 5,308,131 A 5/1994 Galindo et al.
5,474,346 A 12/1995 Fann et al.
5,662,365 A 9/1997 Ghostley
5,683,127 A 11/1997 Chamberlain
5,769,472 A 6/1998 Small
6,386,603 B1 5/2002 Huang
6,612,627 B2 9/2003 Wheatland
6,863,320 B2 3/2005 Huang
6,880,871 B2 * 4/2005 Winardi ..... 292/337

* cited by examiner

*Primary Examiner*—Jennifer H. Gay
*Assistant Examiner*—Alyson M. Merlino
(74) *Attorney, Agent, or Firm*—William G. Lane

(57) ABSTRACT

An improved door latch bolt assembly comprising a cylindrical casing having a front end, a back end and an external surface, and at least one tab extending radially outward from the front end of the cylindrical casing; a bolt; a bolt operating mechanism fixed to the cylindrical casing; and a faceplate having a front side, a back side, and a bolt hole adapted to receive the bolt in a sliding relationship; and a cylindrical sleeve comprising two semi-circular halves joined together, the cylindrical sleeve turnably received at the front end on the external surface of the cylindrical casing and slidably joined to the faceplate to permit the cylindrical casing and the faceplate to turn up to about ten degrees in either direction within the sleeve.

19 Claims, 15 Drawing Sheets

SIX-WAY LATCH BOLT ASSEMBLY

FIELD OF THE INVENTION

The present invention is directed to an improved door latch bolt assembly (sometimes referred to as a door latch bolt, door latch bolt assembly, latch housing, latch bolt assembly, or the like), such as, an entry latch bolt, a privacy latch bolt, a passage latch bolt and a dead latch bolt. In particular, this invention is directed to a door latch bolt assembly that can be employed on mortised doors or non-mortised doors for residential and commercial buildings merely by changing the faceplate and support components thereof.

BACKGROUND OF THE INVENTION

A six-way latch bolt assembly is a latch bolt assembly that is adjustable to a 2⅜ inches and a 2¾ inches backset, and that can be utilized in a square corner mortised door, a round corner mortised door and a non-mortised door. A square corner mortised door means a door adapted to receive a square corner faceplate. A round corner mortised door means a door adapted to receive a round corner faceplate.

Traditionally, a door latch bolt assembly would include a door passage latch bolt assembly, a door privacy latch bolt assembly and a door entry latch bolt assembly. For purposes of this invention a door latch bolt assembly will also include a door dead latch bolt assembly. Virtually every hinged door in a home or commercial building has a door latch bolt assembly. Exterior doors are normally locked with an entry latch bolt assembly, and/or a dead latch bolt assembly. Interior doors are normally shut with a passage latch bolt assembly or a privacy latch bolt assembly. In the door latch bolt assembly industry, it is a common practice to offer one series of latch bolt assemblies for mortised doors (doors mortised on the outer edge or side for a frontplate and backplate) and a separate series of latch bolt assemblies, i.e. drive-in latch bolt assemblies, for non-mortised doors (doors not mortised on the outer edge or side for a frontplate and backplate). Some door latch bolt assemblies have a single plate, the frontplate, rather than both a backplate and frontplate.

Doors, both mortised doors and non-mortised doors, have two large intersecting bores on the latch side of the door, the side opposite the hinge side of a door where the door is supported by door hinges, to receive the door latch bolt assembly. One bore, the latch bore, extends from the exterior side, i.e., the edge, of the latch side of the door into the door to intersect the large face bore, which extends from the front face to the back face of the door. The face bore is normally around 2⅛ inches in diameter. The latch bore is either about ⅞ or about 1 inch in diameter. Some door latch bolt assemblies will only fit in a 1-inch diameter latch bore. Other door latch bolt assemblies will fit in either a ⅞-inch or 1-inch latch bore.

The outer edge or the latch side of a mortised door normally has a large rectangular faceplate with square or round corners that are received in a mortised cut in the edge of the door. The faceplate may be secured to a backplate which is affixed to the latch bolt assembly. The backplate is normally integral with the door latch bolt assembly. Two screw holes extend through the faceplate, and the backplate when present. The faceplate and backplate are screwed into the mortise cut on the edge of the latch side of the door with wood screws extending through the two screw holes. The faceplate and backplate secure the latch bolt assembly into the door and support the latch bolt assembly in the latch bore. In other words, the faceplate/backplate support a small latch bolt assembly in a 1-inch diameter latch bore. If a round faceplate is provided, drive-in sleeves are usually provided to bridge the space between the cylindrical casing of the assembly and the wall of the 1-inch latch bore. Sometimes the faceplate is integral with the sleeve.

Ideally, a latch bolt assembly would be usable on the mortised doors and non-mortised doors. This would simplify manufacturing, inventorying, reordering, and save on retail shelf space. Unfortunately the integral faceplate, and backplate if present, of the mortised type latch bolt assembly for the mortised door precludes the use of such latch bolt assembly on non-mortised doors, and the lack of a faceplate or backplate on the drive-in latch bolt assembly for non-mortised doors precludes the use of the drive-in door latch bolt assembly on mortised doors for esthetic and other reasons. Thus two separate latch bolt assemblies are required-one for mortised doors and one for non-mortised doors.

Some non-mortised doors have a ⅞-inch latch bore and others have a 1-inch latch bore. A latch bolt assembly with a sleeve is used in a one-inch (diameter) latch bore when there is no backplate to support the assembly in the bore. The one-inch latch bore supports the cylindrical casing of the latch bolt assembly in conjunction with a sleeve. The sleeve usually surrounds the cylindrical casing of the latch bolt assembly. Most doors today are drilled with a one-inch latch bore.

It is an object of the present invention to provide a door latch bolt assembly, including an entry latch bolt assembly, a passage latch bolt assembly, a privacy latch bolt assembly and a dead latch bolt assembly, that can be fitted with a faceplate and backplate to provide a mortised type door latch bolt assembly for mortised doors, and that can be fitted with the round faceplate and sleeve or collar to provide a drive-in door latch bolt assembly for non-mortised doors.

It is a further object of this invention to provide a drive-in door latch bolt assembly for non-mortised doors that can be rotated after installation in the latch bore to align the latch bolt or dead bolt parallel with the door faces after insertion of the latch bolt assembly in the latch bore. This insures that the bolt operating mechanism is perpendicular to the latch operating spindle and the bolt flat[s] are parallel to the flat sides of the strike or strike plate.

It is another object of the present invention to provide a door latch bolt assembly that can be used interchangeably on non-mortised doors and mortised type doors.

It is still another object of the present invention to provide a door latch bolt assembly that can be used interchangeably on mortised doors or non-mortised doors with a one-inch latch bore.

It is an additional object of the present invention to provide a passage latch bolt assembly, privacy latch bolt assembly and a dead latch bolt assembly that can be used interchangeably in a one-inch latch bore with a faceplate/backplate or round faceplate and sleeve.

SUMMARY OF THE INVENTION

The present invention is directed to an improved door latch bolt including: a door latch bolt assembly comprising a cylindrical casing having a front end, a back end and an external surface, and at least one tab extending radially outward from the front end of the cylindrical casing; a bolt adapted to slide in or out of the front end of the cylindrical casing; a bolt operating mechanism fixed to the back end of the cylindrical casing and adapted to slide the bolt in and out of the cylindrical casing; a faceplate having a front side, a back side, and a bolt hole adapted to receive the bolt in a sliding relationship, the faceplate having two opposing semi-circular flanges extending axially from the back side, each flange having two circumferential ends, and a slot with an open end and a closed end in each of the semi-circular flange's circumferential ends, each tab of the cylindrical casing positioned against the back side of the faceplate between the two opposing semi-circular flanges; and a cylindrical sleeve comprising two semi-circular halves joined together, the cylindrical sleeve having a front side and turnably received at the front end on the external surface of the cylindrical casing, each semi-circular half having a horn extending axially outward from its front side, each horn having opposing prongs extending circumferentially, each prong adapted to be slidably received in one of the slots in the semi-circular flanges, each tab captured between the back side of the faceplate and a horn of one of the semi-circular halves to secure the faceplate to the front end of the cylindrical casing. The bolt can be a dead bolt, an entry bolt, or a privacy bolt.

Preferably, the cylindrical casing has two opposing tabs extending radially outward from the front end. Preferably, the flanges on the faceplate form a notch between the circumferential ends of the flanges and the backside of the faceplate, each notch adapted to receive a tab. Each tab is retained in a notch by a horn.

In another embodiment, the faceplate has arcuate ribs extending radially outward from its backside bridging the circumferential ends of the flanges. A notch is formed between the circumferential ends of the flanges and each rib; each notch is adapted to receive a tab. Each tab is retained in the notch by a horn.

In the preferred embodiment of the invention, the slots in the flanges are longer than the prongs of the horns permitting the door latch bolt assembly and face to be turned on the cylindrical casing up to about ten degrees in each direction.

In the preferred embodiment of the invention at least one of the tabs has a v-notch on its backside, and the horn of the semi-circular sleeve half opposite said tab has a v-nib on its front side adapted to engage the v-notch to register the faceplate with respect to the prongs received in the slots of the flanges so that each prong is approximately equal distance from the closed end of the slots.

Most preferably each tab has a v-notch on its backside, and the horns of each semi-circular sleeve half opposite each tab has a v-nib on its front side adapted to engage the v-notch of the tab to register the prongs received in the slots of the flanges equal distance from the closed end of the slots.

Preferably each circumferential end of each semi-circular half of the sleeve has at least one peg extending circumferentially from each circumferential end and a bore extending circumferentially into the circumferential end, the peg of each semi-circular half in registration with the bore of the other sleeve semi-circular half, each peg of one semi-circular half adapted to be received in the bore of the other semi-circular half to secure the two semi-circular halves together to form the cylindrical sleeve.

Preferably the pegs have a cross-section of a regular hexagon with a maximal diameter 2*a*, where a is the length of one side of the hexagon, and a minimal diameter av3. The bores of the semi-circular sleeves having a cross section of a full circle with a diameter between the maximal diameter and the minimal diameter of the peg.

If the bore extending into one the circumferential ends of the semi-circular sleeves has a cross-section of a regular hexagon, the hexagon has a maximal diameter 2*a*, where a is the length of one side of the hexagon, and a minimal diameter av3. The pegs of the semi-circular sleeves will then have a cross section of a full circle with a diameter between the maximal diameter and the minimal diameter of the bore.

Although pegs, or alternatively the bores, with a hexagonal cross-section are preferred, other cross-sections can be used, such as triangular, square, rectangular, pentagonal, octagonal cross-sections, and the like.

The bolt of the door latch bolt assembly is selected from the group consisting of an entry latch bolt, a passage latch bolt, or a dead bolt. A privacy latch bolt and a passage latch bolt both employ a passage latch bolt.

Another embodiment of the improved latch bolt comprises: a cylindrical casing having a front end, a back end and an external surface, and at least two opposing tabs extending radially outward from the front end of the cylindrical casing; a bolt adapted to slide in or out of the cylindrical casing; a bolt operating mechanism fixed to the back end of the cylindrical casing and adapted to slide the bolt in and out of the cylindrical casing; a faceplate having front side and back side and a bolt hole adapted to receive the bolt in a sliding relationship, the faceplate having two opposing semi-circular flanges extending axially from the back side, each flange having two circumferential ends and a slot with an open end and a closed end in each of the semi-circular flanges' circumferential ends, and a slot formed between the circumferential ends of the flanges and the back side of the faceplate, each slot adapted to receive a separate tab; and a cylindrical sleeve comprising two semi-circular sleeve halves joined together, the cylindrical sleeve turnably received on the external surface of the cylindrical casing at the front end of the cylindrical casing with each tab of the cylindrical casing positioned against the back side of the faceplate, each semi-circular half having a horn extending axially out from the front side, each horn having opposing prongs extending circumferentially, each prong adapted to be slidably received in one of the slots in the flanges, each tab retained between the back side of the faceplate and a horn of one of the semi-circular halves to secure the faceplate to the front end of the cylindrical casing; the slots longer than the prongs to permit the prongs to be slidably moved in the slots when the cylindrical casing is turned in the cylindrical sleeve.

Another embodiment of the present invention is directed to an improved latch bolt comprising: a cylindrical casing having a front end, a back end and an external surface, and at least two opposing tabs extending radially outward from the front end of the cylindrical casing; a bolt adapted to slide in or out of the cylindrical casing; a bolt operating mechanism fixed to the rear of the cylindrical casing and adapted to slide the bolt in and out of the cylindrical casing; a faceplate having front side and back side and a bolt hole adapted to receive the bolt in a sliding relationship, the faceplate having two opposing semi-circular flanges extending axially from the back side, each flange having two circumferential ends and a slot with an open end and a closed end in each of the semi-circular flanges' circumferential ends, and a slot formed between each circumferential end of the flanges and each rib, each slot adapted to receive a tab; and a cylindrical sleeve comprising two semi-circular sleeve halves joined together, the cylindrical sleeve turnably received on the external surface of the cylindrical casing at the front end of the cylindrical casing with each tab of the cylindrical casing positioned against the back side of the faceplate, each semi-circular half having a horn with opposing prongs extending circumferentially on its front side, each prong adapted to be slidably received in one of the slots in the flanges and to capture each tab between the back side of the faceplate and a horn of one of the semi-circular halves to secure the faceplate to the front end of the cylindrical casing, the slots are longer than the prongs permitting the cylindrical casing and the faceplate to be turned up to about ten degrees in each direction with respect to the cylindrical sleeve.

A still further embodiment of the improved latch bolt comprises: a cylindrical casing having a front end, a back end and an external surface, and two opposing tabs extending radially outward from the front end of the cylindrical casing, each tab having a back side and a v-notch on its back side; a bolt adapted to slide in or out of the cylindrical casing; a bolt operating mechanism fixed to the rear of the cylindrical casing and adapted to slide the bolt in and out of the cylindrical casing; a faceplate having front side and back side and a bolt hole adapted to receive the bolt in a sliding relationship, the faceplate having two opposing semi-circular flanges extending axially from the back side, each flange having two circumferential ends and a slot with an open end and a closed end in each of the semi-circular flanges' circumferential ends, and a slot formed between the circumferential ends of the flanges and the back side of the faceplate, each slot adapted to receive a tab; and a cylindrical sleeve comprising two semi-circular sleeve halves joined together, the cylindrical sleeve turnably received on the external surface of the cylindrical casing at the front end of the cylindrical casing with each tab of the cylindrical casing positioned against the back side of the faceplate, each semi-circular half having a horn with opposing prongs extending circumferentially on its front side, each prong adapted to be slidably received in one of the slots in the flanges, each tab captured between the back side of the faceplate and a horn of one of the semi-circular halves to secure the faceplate to the front end of the cylindrical casing, the slots are longer than the prongs permitting the cylindrical casing and the faceplate to be turned up to about ten degrees in each direction with respect to the cylindrical sleeve, and each semi-circular sleeve half opposite each tab has a v-nib on its front side adapted to engage a v-notch of one of the tabs to register the cylindrical sleeve with respect to the door latch bolt assembly so that the prongs received in the slots are equal distance from the closed end of the slots.

DESCRIPTION OF THE INVENTION

Figure 1A:
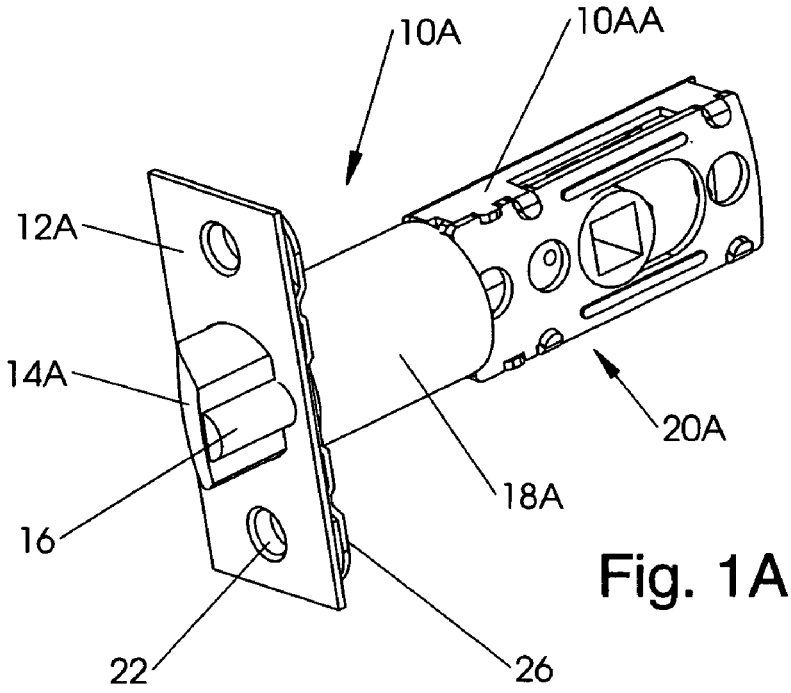
FIG. 1A is a top, front perspective view of an entry latch bolt of the present invention.
Figure 1B:
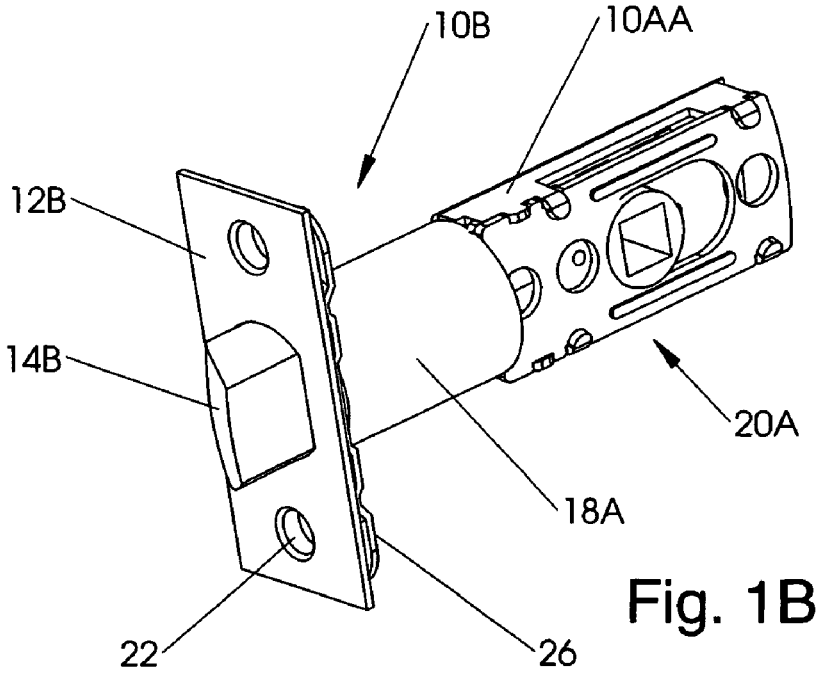
FIG. 1B is a top, front perspective view of a passage latch bolt of the present invention.
Figure 1C:
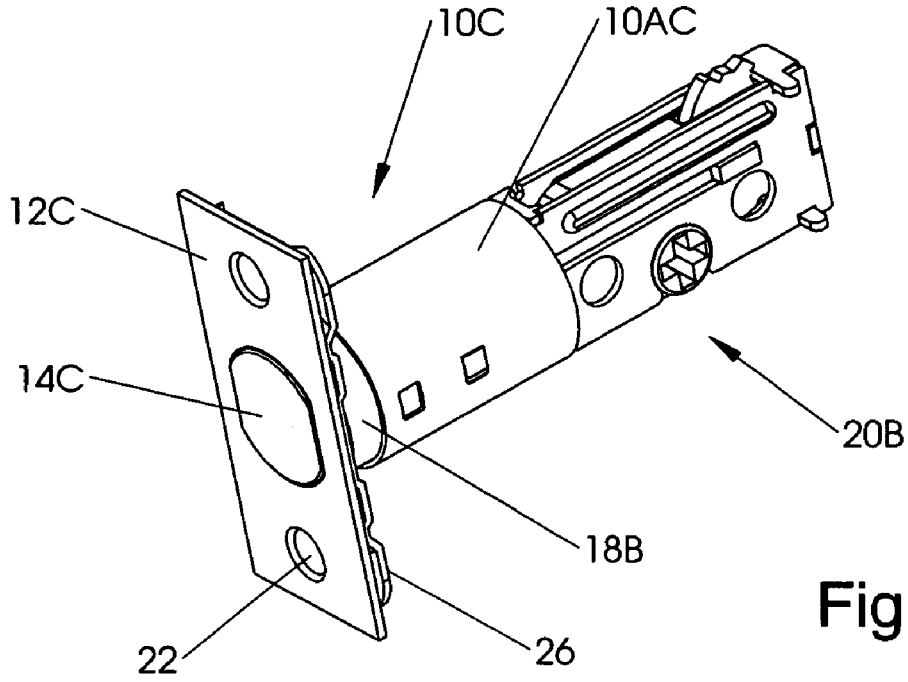
FIG. 1C is a top, front perspective view of a dead latch bolt of the present invention at a 2⅜ inch backset.
Figure 1D:
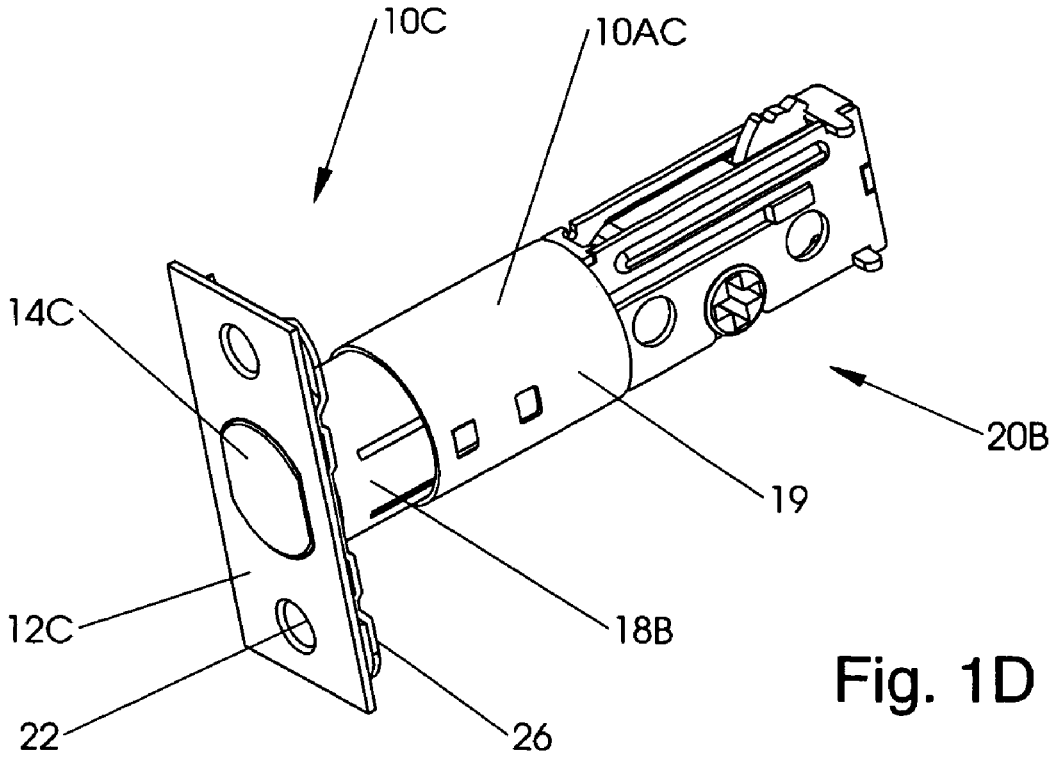
FIG. 1D is a top, front perspective view of a dead latch bolt of FIG. 1C at a 2¾ inch backset.
Figure 2:
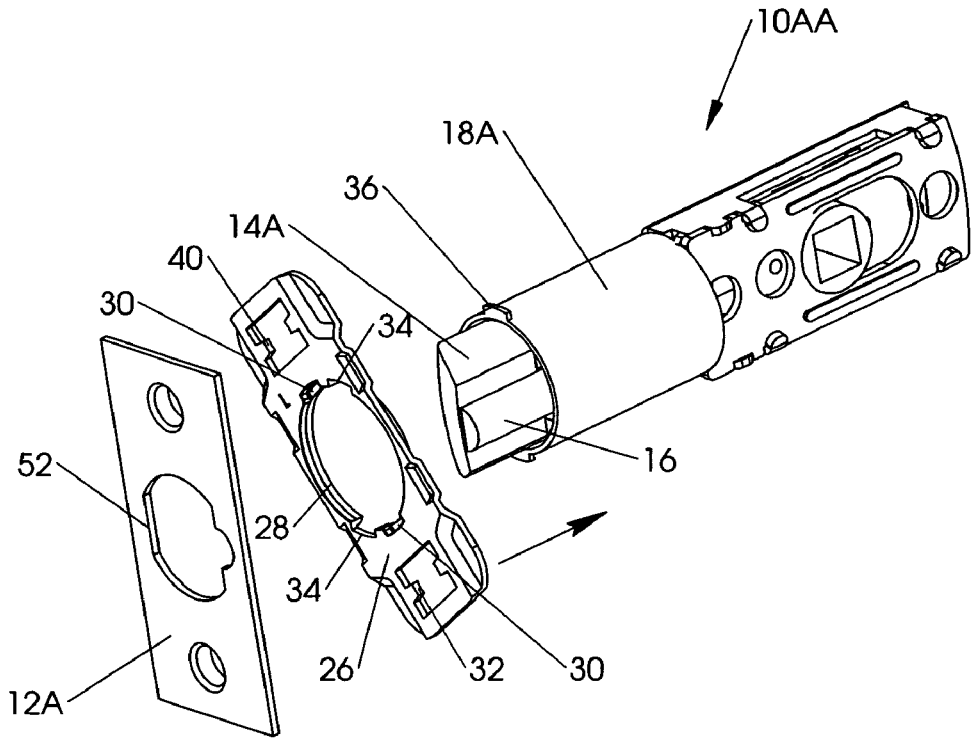
FIG. 2 is a top, front telescopic perspective view of a partially assembled entry latch bolt of FIG. 1A.
Figure 3:
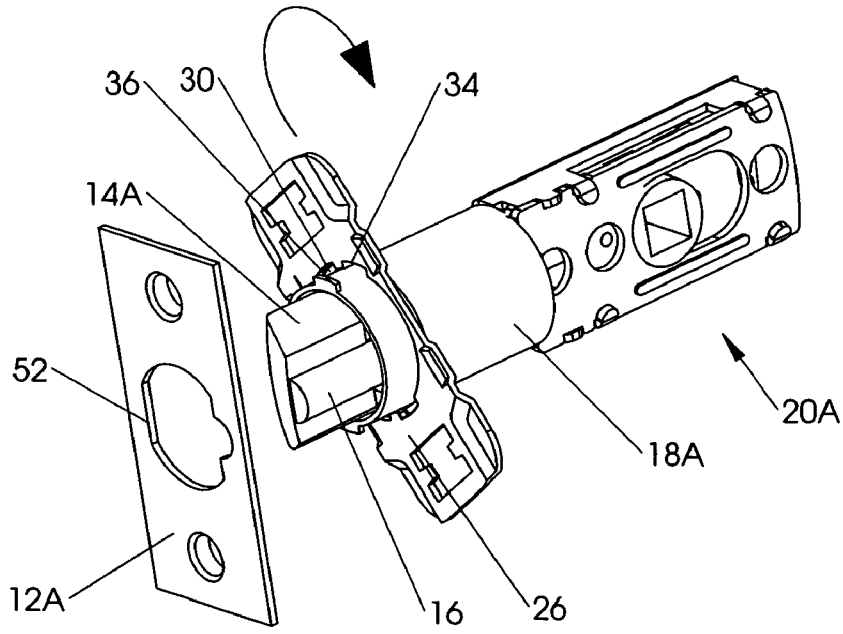
FIG. 3 is a top, front telescopic perspective view of a partially assembled entry latch bolt of FIG. 1A.
Figure 4:
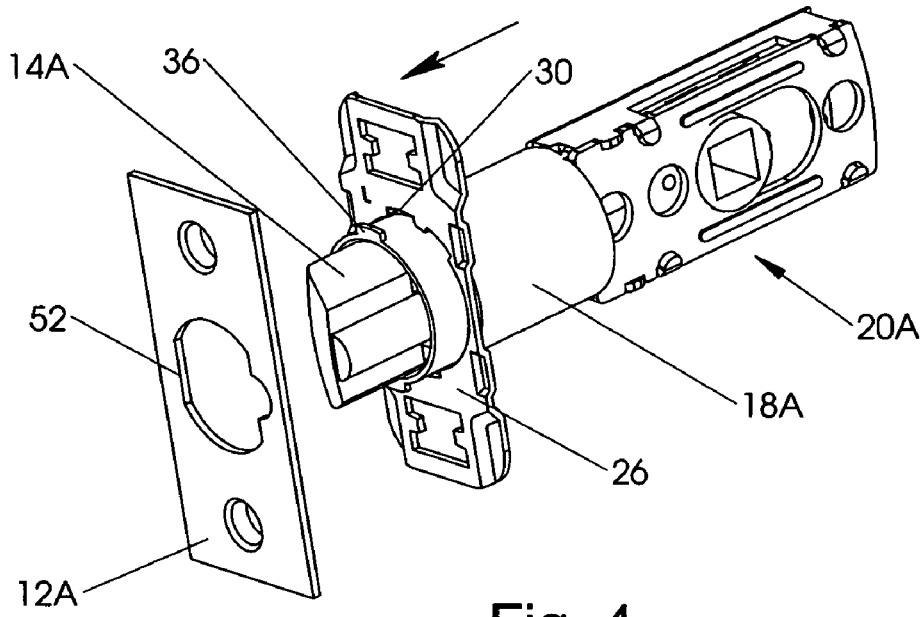
FIG. 4 is a top, front telescopic perspective view of a partially assembled entry latch bolt of FIG. 1A.
Figure 5:
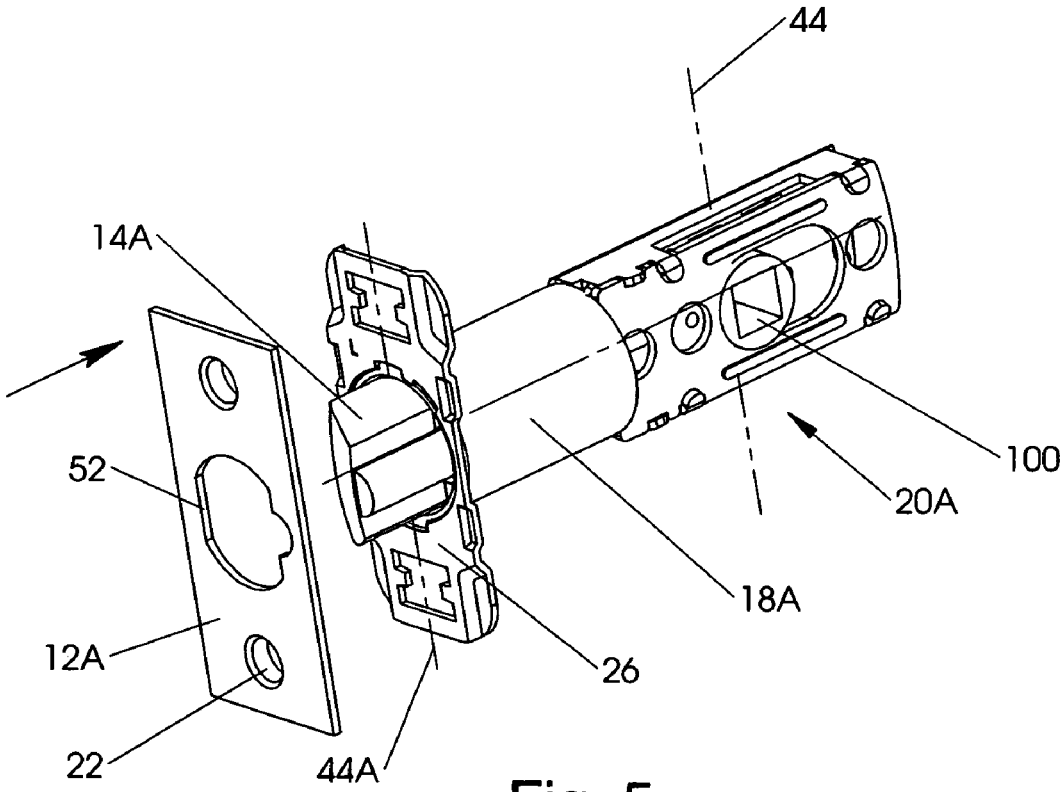
FIG. 5 is a top, front telescopic perspective view of a partially assembled entry latch bolt of FIG. 1A.
Figure 6:
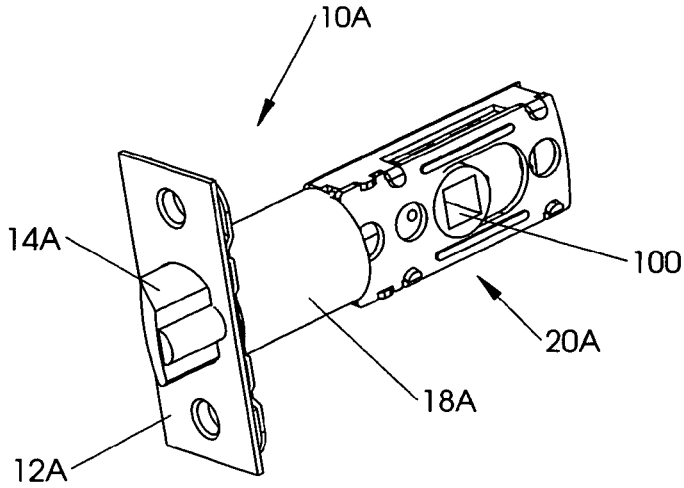
FIG. 6 is a top, front perspective view of an assembled entry latch bolt of FIG. 1A.
Figure 7:
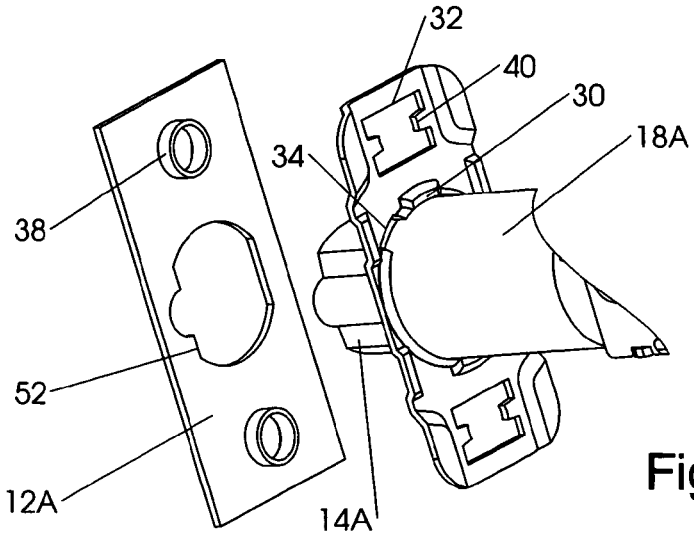
FIG. 7 is a top, back partial perspective view of the partially assembled entry latch bolt of FIG. 5.
Figure 8:
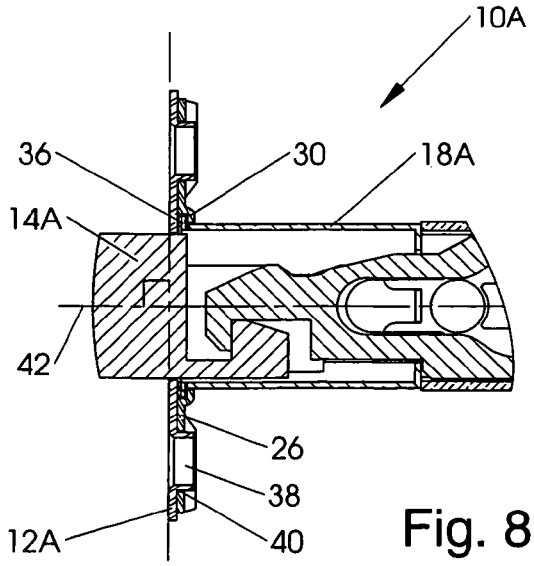
FIG. 8 is a partial cross-sectional view of the front portion of the entry latch bolt of FIG. 6.
Figure 9:
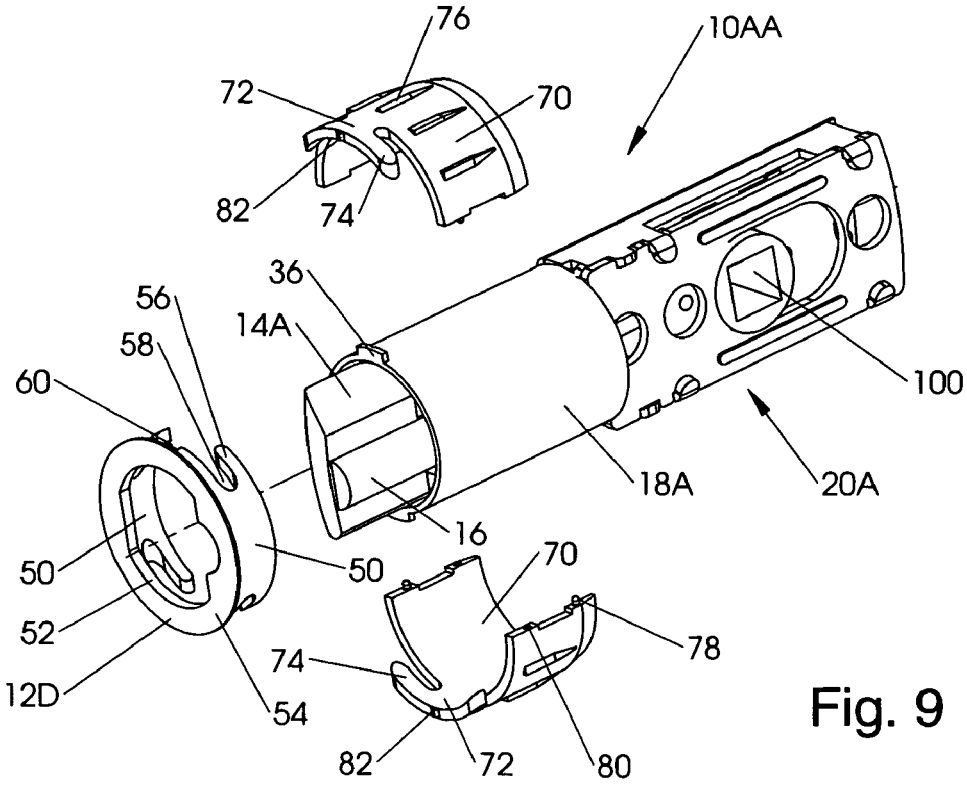
FIG. 9 is a top, front telescopic perspective view of a partially assembled entry latch bolt for a one-inch latch bore of FIG. 18.
Figure 10:
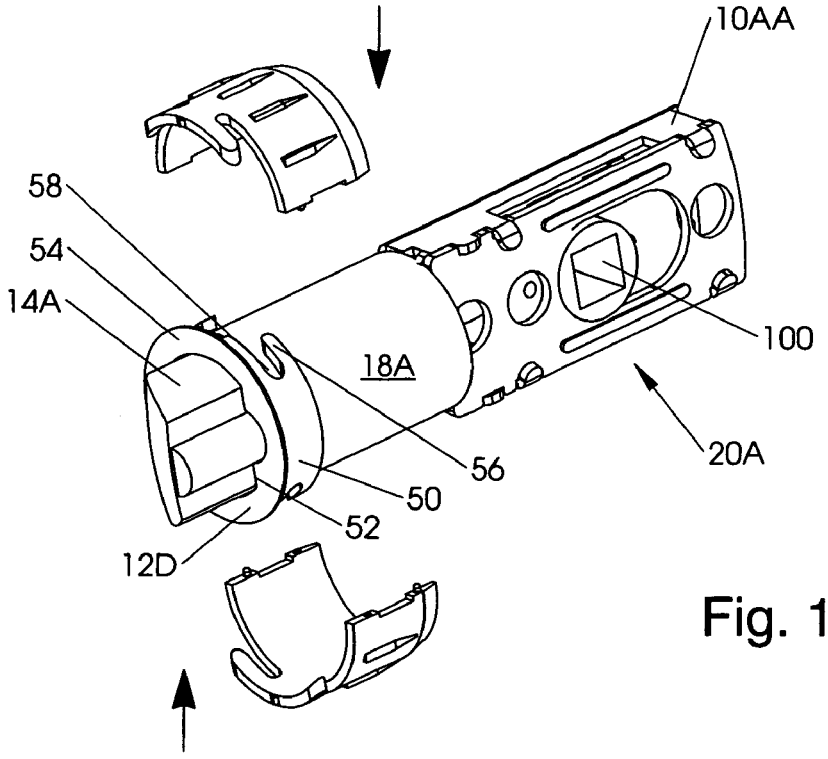
FIG. 10 is a top, front telescopic perspective view of a partially assembled entry latch bolt for a one-inch latch bore of FIG. 18.
Figure 11:
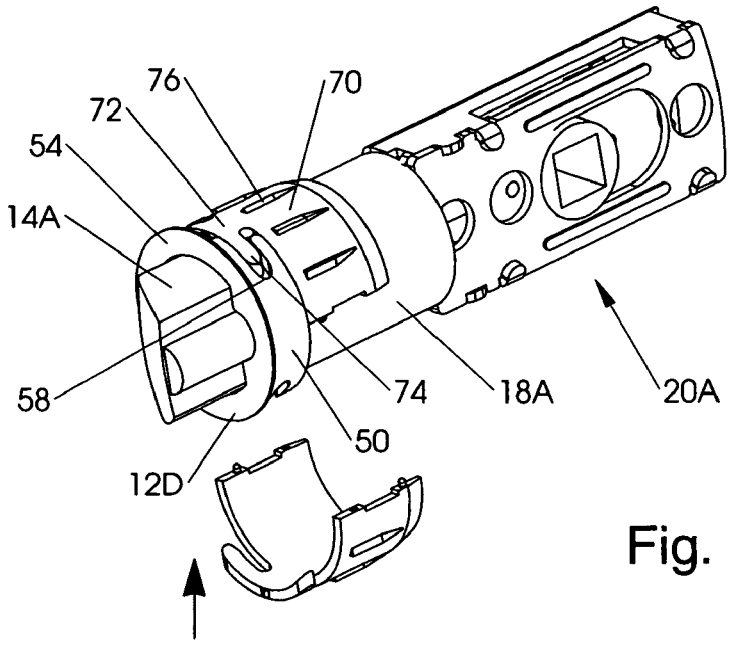
FIG. 11 is a top, front telescopic perspective view of a partially assembled entry latch bolt for a one-inch latch bore of FIG. 18.
Figure 12:
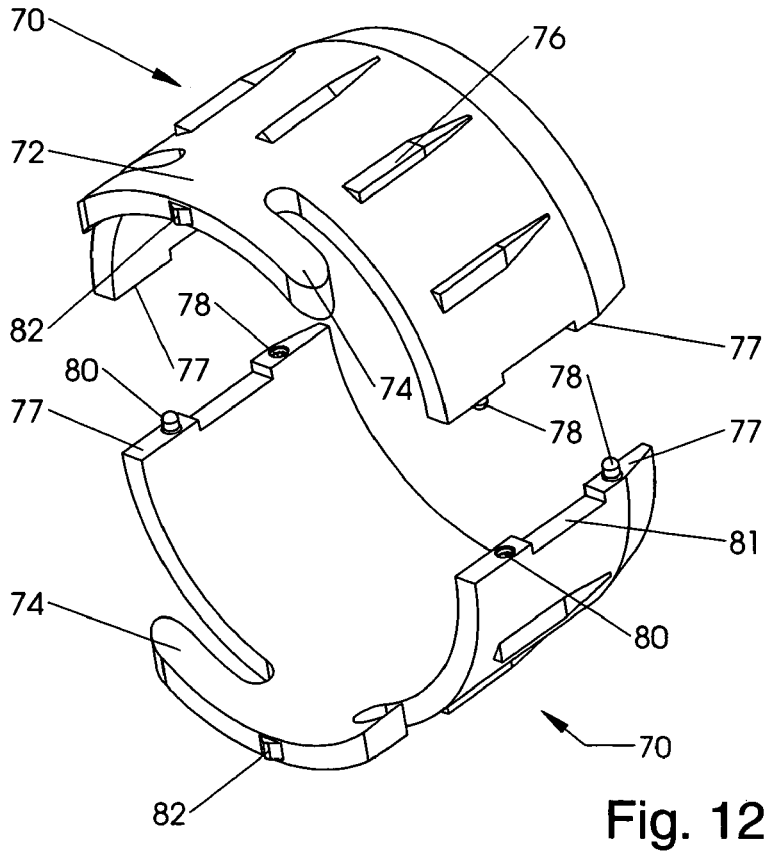
FIG. 12 is an enlarged top, front telescopic perspective view of the cylindrical sleeve of the entry latch bolt for a one-inch latch bore of FIG. 18.
Figure 13:
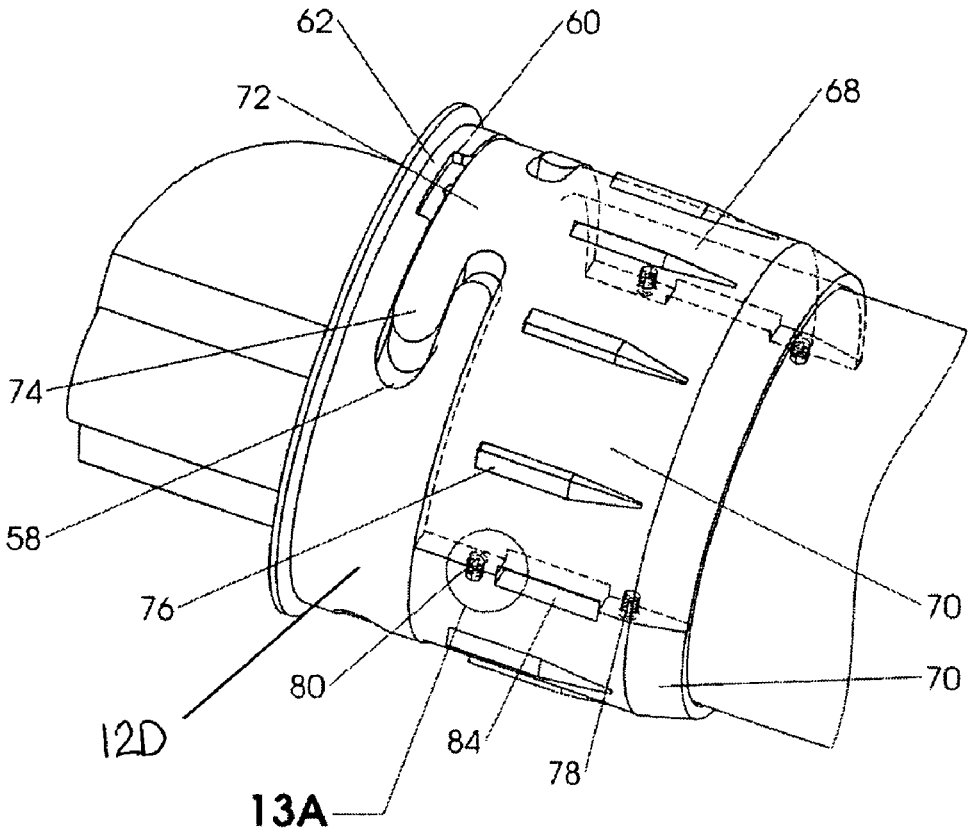
FIG. 13 is a top partial rear perspective view of the front portion of the entry latch bolt for a one-inch latch bore of FIG. 18.
Figure 13A:
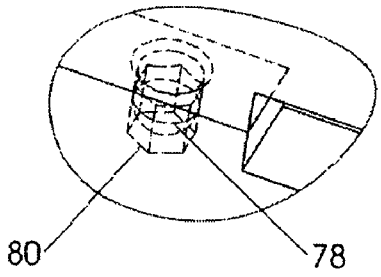
FIG. 13A is an enlarged view of encircled section 13A of FIG. 13.
Figure 14:
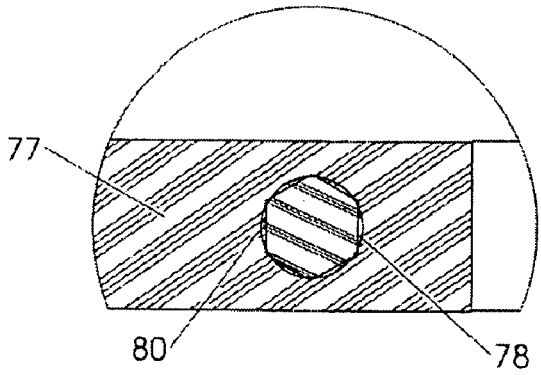
FIG. 14 is a cross sectional view within the encircled section 13A of FIG. 13.
Figure 15:
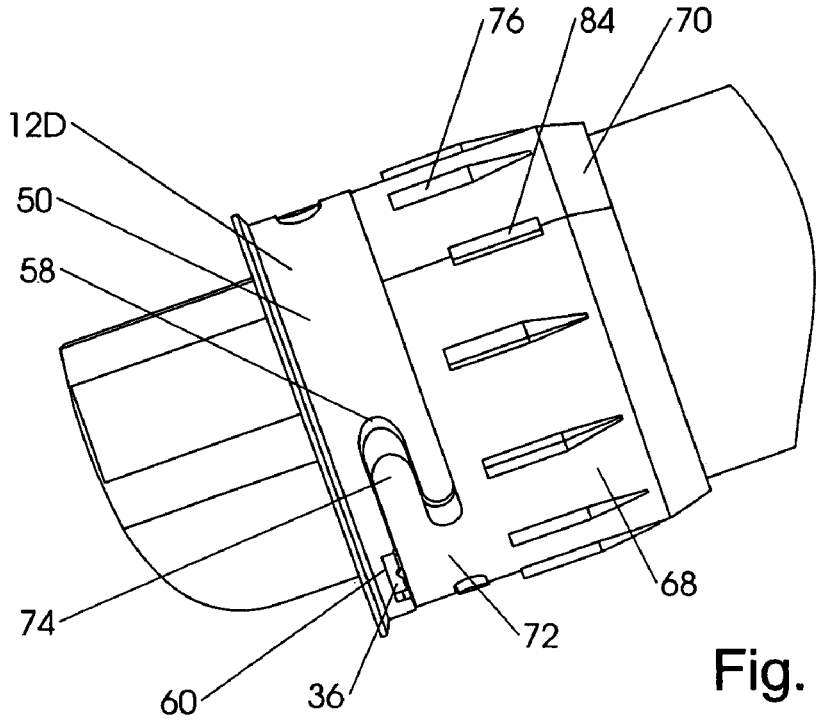
FIG. 15 is a rotated plan side view of the front portion of the entry latch bolt for a one-inch latch bore of FIG. 18.
Figure 16:
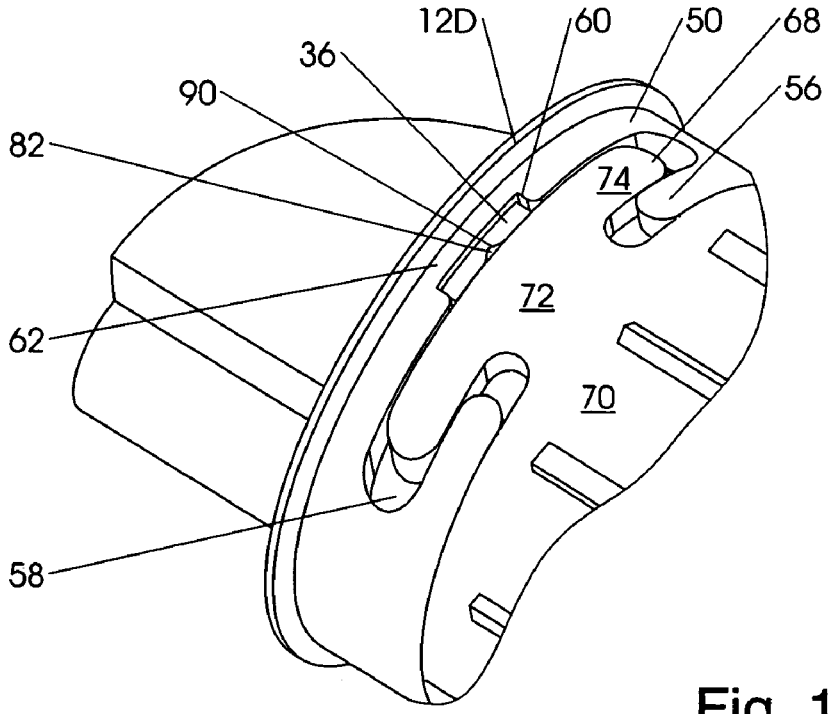
FIG. 16 is a partial top, rear perspective view of the front portion of the entry latch bolt for a one-inch latch bore of FIG. 18.
Figure 17:
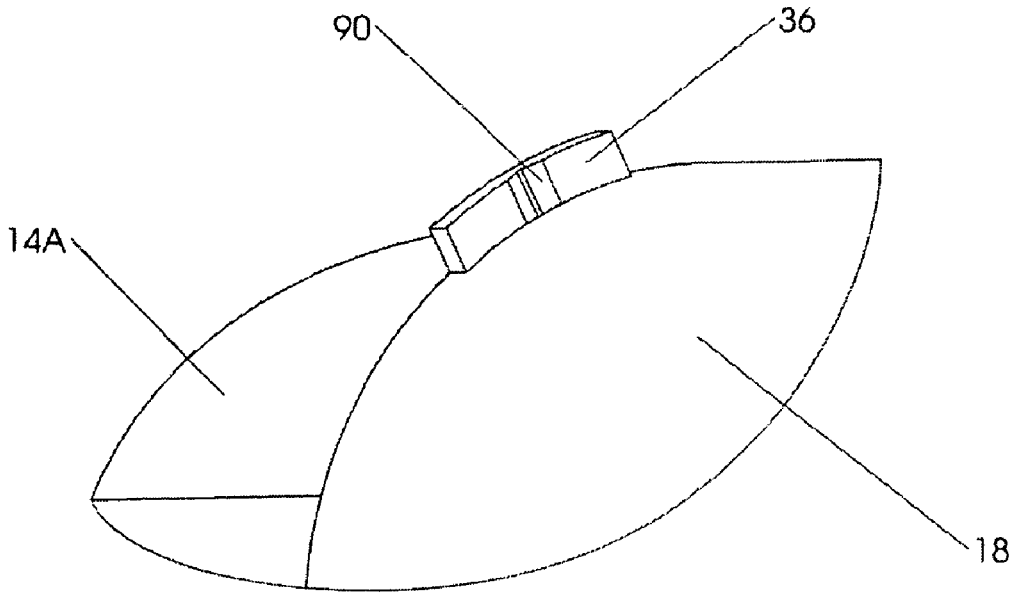
FIG. 17 is a partial, top enlarged rear perspective view of the front portion of the entry latch bolt assembly of FIGS. 2 and 9.
Figure 18:
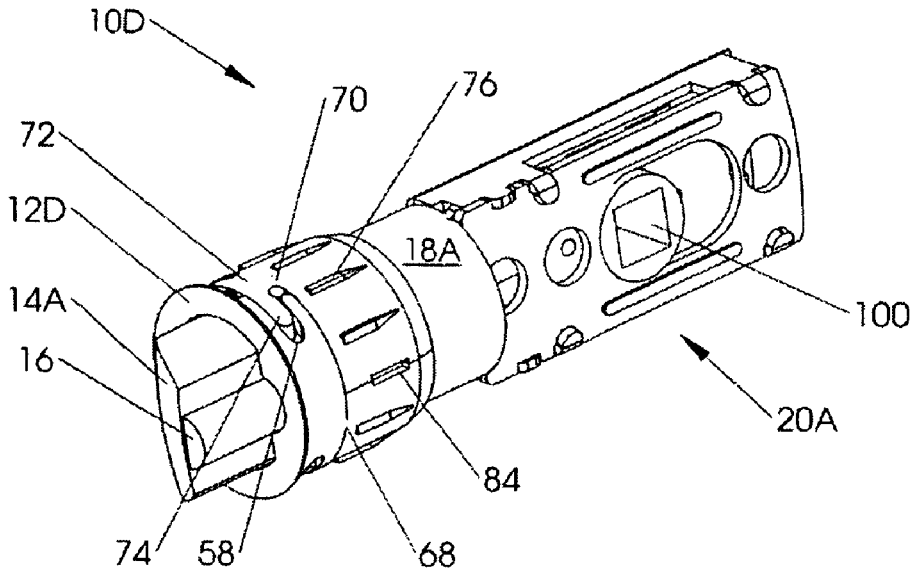
FIG. 18 is a top, front perspective view of the entry latch bolt for a one-inch latch bore in a non-mortised door of the present invention.
Figure 19:
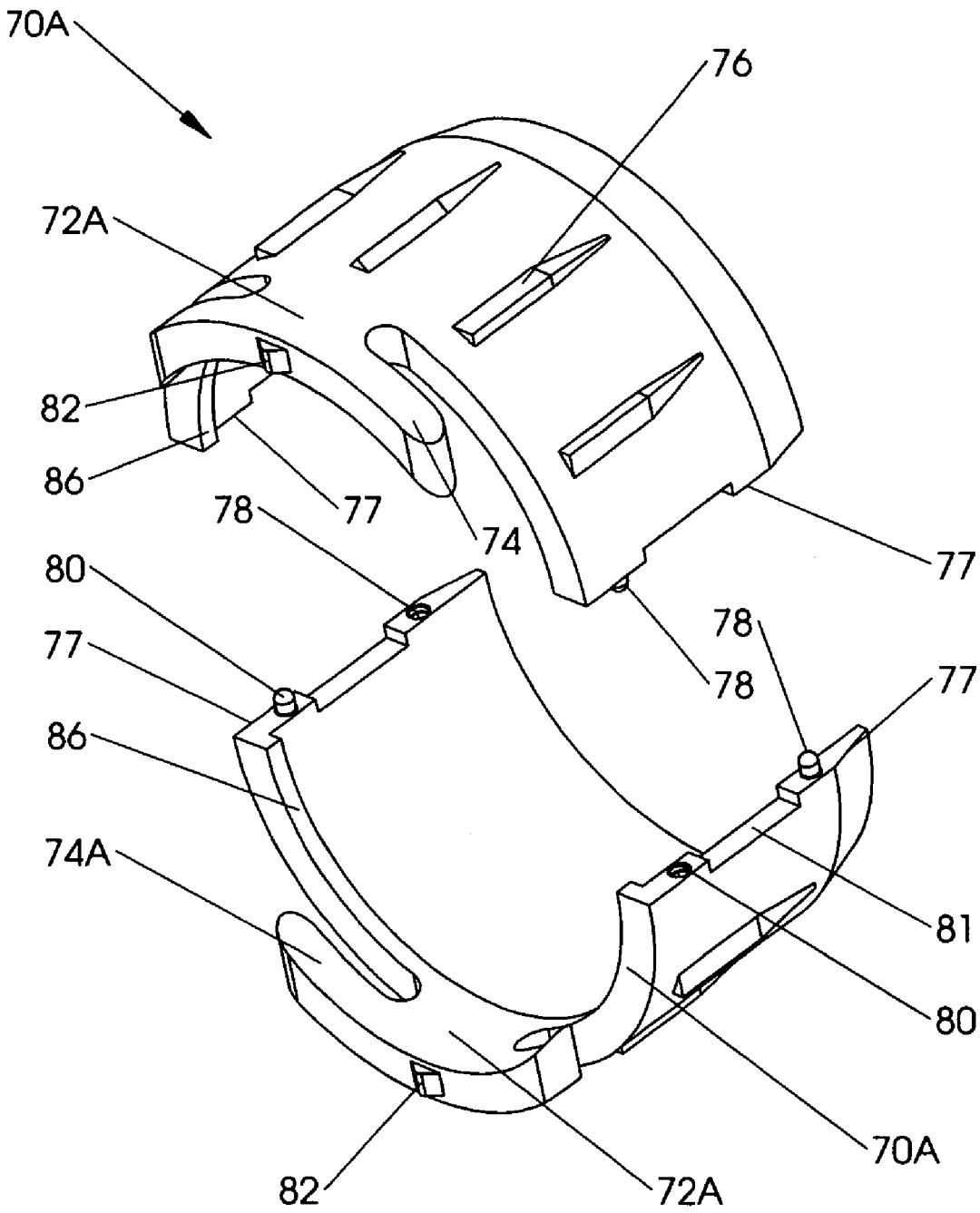
FIG. 19 is an enlarged top, front telescopic perspective view of the cylindrical sleeve of the dead latch bolt of FIGS. 1C, 1D & 20-24.
Figure 20:
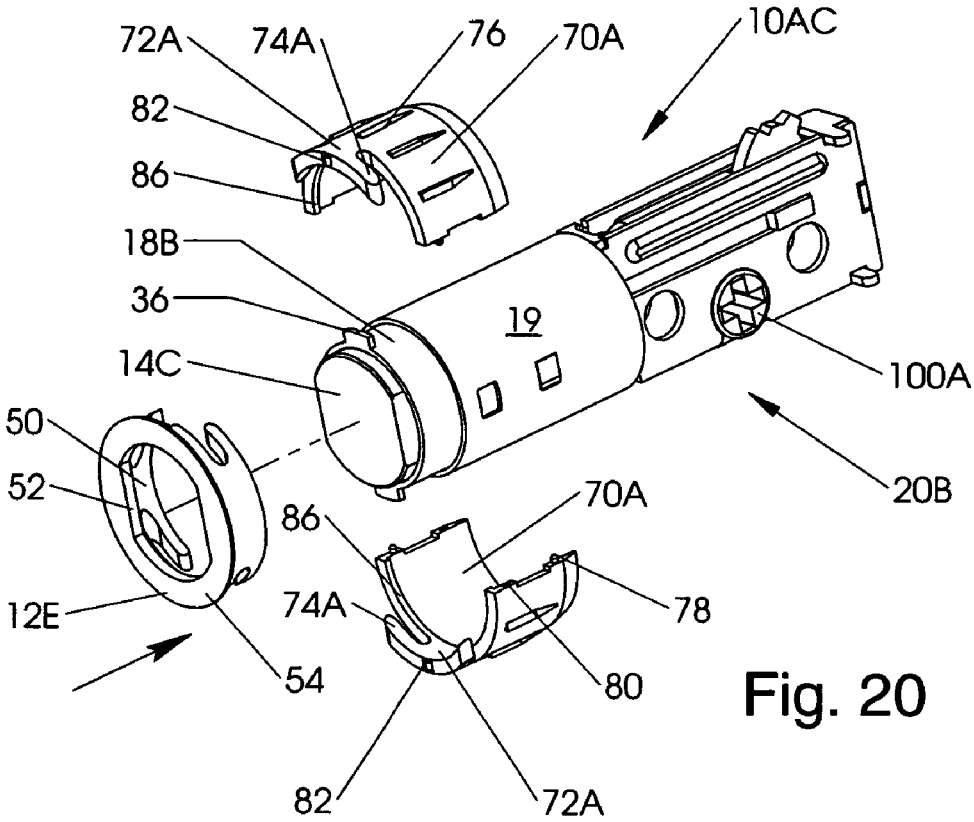
FIG. 20 is a top, front telescopic perspective view of a partially assembled dead latch bolt for a one-inch latch bore of FIG. 23.
Figure 21:
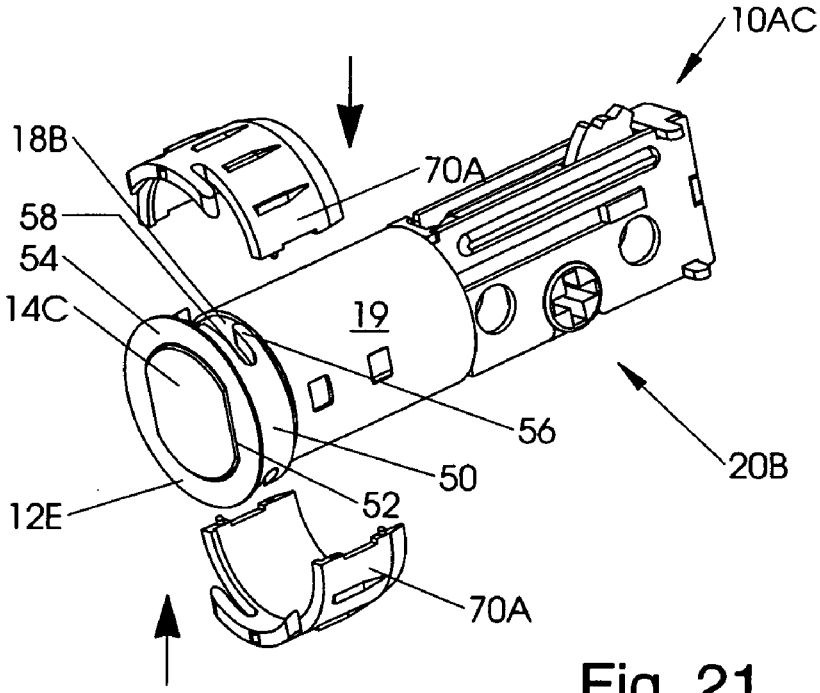
FIG. 21 is a top, front telescopic perspective view of a partially assembled dead latch bolt for a one-inch latch bore of FIG. 23.
Figure 22:
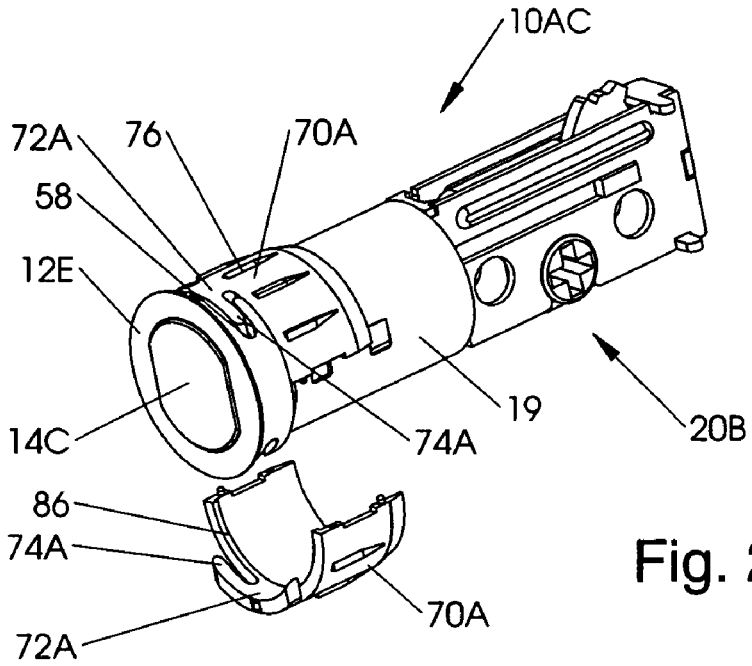
FIG. 22 is a top, front telescopic perspective view of a partially assembled dead latch bolt for a one-inch latch bore of FIG. 23.

Referring to FIGS. 1A and 1B, the entry latch bolt assembly 10A and passage and privacy latch bolt assembly 10B for mortised doors comprises a bolt operating mechanism 20A secured to a cylindrical casing 18A which in turn is secured to a backplate 26 (See FIGS. 2-5 and 7) which has an attached faceplate 12A or 12B. Referring to FIGS. 1C and 1D dead latch bolt assembly 10C for mortised doors comprises a bolt operating mechanism 20B secured to a cylindrical casing 18B which in turn is secured to a backplate 26 (See FIGS. 2-5 and 7) which has an attached faceplate 12C.

Each faceplate 12A, 12B and 12C and backplate 26 has holes 22 and boss openings 32, respectively, to receive wood screws that are screwed into the edge of a mortised door on the latch side to secure the latch bolt assemblies in the door and support the latch bolt assemblies in the door latch bore [the latch bolt assemblies are also supported by the knob/lever assembly (not shown)]. The entry bolt 14A of entry latch bolt assembly 10A has a dead locking plunger 16. The hole in the strike plate (not shown) of a door frame has a hole large enough to receive the entry bolt but not the dead locking plunger 16 when the door is closed thus depressing the dead locking plunger. When the dead locking plunger is depressed, the entry bolt 14A is locked and cannot be forced back into the cylindrical casing by exerting force on the entry bolt (the entry bolt can be withdrawn by actuation of the bolt operating mechanism). The dead locking plunger prevents a thief or burglar from forcing open the latch bolt assembly with a credit card or other instrument.

The backset of latch bolt assemblies 10A, 10B and 10C is adjustable to 2⅜ or to 2¾ inches. For latch bolt assemblies 10A and 10B the adjustment is made by moving the cam 100 of the bolt operating mechanism 20A forward or backward. For dead latch bolt assembly 10C the adjustment from 2⅜ to 2¾ inches or visa versa is made by rotating and moving the cylindrical casing 18B forward out of or backward into the outer sleeve 19. To go to a 2⅜ inches backset, the cylindrical casing 18B is rotated and moved into the outer sleeve and rotated back. The operation is reversed to set the backset to 2¾ inches.

Referring to FIGS. 2 through 8, the latch bolt mechanism 10AA of the entry latch bolt assembly 10A is adapted to detachably receive a backplate 26 and a faceplate 12A. The backplate 26 can be detachably secured to the cylindrical casing 18A. The cylindrical casing, which houses the entry bolt 14A and its actuating mechanism (not shown), has two diametrically opposing tabs 36 on its front end. The backplate 26 has an opening 28 slightly larger than the outer diameter of the cylindrical casing 18A. Two diametrically opposing slots 34 extend outward from the opening 28 and are adapted to slide over the tabs to permit the cylindrical casing 18 to receive the backplate 36 (See FIGS. 2 & 3). The backplate is rotated to an upright position on the cylindrical casing (See FIGS. 3 & 4). The backplate has two diametrically opposing pockets 30 extending to the opening 28 and facing the front of the backplate. The backplate 26 is moved forward on the cylindrical casing to seat the tabs 36 in the pockets 30 (See FIGS. 4 & 5). When the tabs 36 are seated in the pockets 30, the backplate is positioned on the front of the cylindrical casing 18A in an upright position parallel to the upright orientation of the bolt operating mechanism 20A (See FIG. 5 where phantom line 44 represents the upright axis of the door latch bolt assembly). The faceplate 12A has a bolt opening 52 adapted to receive the entry bolt 14A in sliding operating relationship. The faceplate also has protruding bosses 38 extending back from the backside of the face place from holes 22. The protruding bosses 38 are adapted to be received within the boss openings 32 of the backplate (See FIGS. 7 & 8). Opposing fingers 40 extending into the boss openings 32 pinch the side of the bosses 38 to detachably join the backplate and faceplate together in a friction fit (See FIG. 8). The faceplate is detachably joined to the backplate when the backplate is properly positioned on the cylindrical casing (See FIGS. 5 & 6). When the faceplate and backplate are joined together, the tabs 36 are captured in pockets 30 securing the backplate 26 and faceplate 12A to the door latch bolt assembly 10A at a right angle to the longitudinal axis 42 of the latch bolt mechanism (See FIG. 8).

Referring to FIGS. 9 through 18, the latch bolt mechanism 10AA is also adapted to detachably receive a circular or round faceplate 12D. The round faceplate 12D has a planar flat front surface 54 and a bolt opening 52 adapted to receive the entry bolt 14A in sliding operating relationship. Two opposing semi-circular flanges 50 extend back from the backside of the round faceplate. The flanges have circumferential ends 56. The circumferential ends of the opposing flanges are spaced apart. Each circumferential end has a slot 58 open to the circumferential end. Two tab receivers 60 are formed between the circumferential ends of the opposing semi-circular flanges (See FIGS. 13, 15 & 16). The round faceplate is positioned on the cylindrical casing 18A with the tabs 36 received in the tab pockets 60 (FIGS. 10, 13,15 and 16) and the front end of the cylindrical casing 18A received within the semi-circular flanges (See FIGS. 9 & 10). Optionally a small rib 62 extends back from the back side of the round faceplate 12D and bridges the circumferential ends of opposing flanges. When the ribs 62 are present, the front side of the tab pocket 60 is the rib. When the rib is not present, the back side of the round faceplate 12D is the front side of the tab pocket (not shown). The diametrically opposing tab pockets 60 are adapted to receive the diametrically opposing tabs 36. If the tabs 36 are not diametrically opposed, the tab pockets 60 are positioned to receive the tabs in whatever position they are situated on the front of the cylindrical casing 18A.

The round faceplate 12D is secured on the latch bolt mechanism 10AA by the cylindrical sleeve 68 assembled from two semi-circular sleeve halves 70. The semi-circular sleeve halves are detachably joined together to form the full cylindrical sleeve 68 (See FIGS. 11-13, 15, 16 & 18) which encircles the front of the cylindrical casing (See FIGS. 13, 15 & 16). Each semi-circular sleeve half 70 has a horn 72 extending from its front side. Each horn 72 has two prongs 74 extending circumferentially from the horn and a registration nib 82 on the front of the horn. The outer surface of the sleeve half 70 has a series of parallel ribs 76 circumferentially positioned around the outer surface and extending axially. Each sleeve half has circumferential ends 77. Each end 77 has a peg 78 on the front or back circumferential end and a bore 80 opposite thereto. Preferably the peg on one circumferential end of the sleeve will be at the front and the peg of the other circumferential end will be at the back (See FIG. 12). The peg can have a normal hexagonal cross-section with a maximum diameter measured across the diametrically opposed vertices or corners of the peg and a minimum diameter measured across diametrically opposing flat sides or edges of the peg. The bore 80 having the cross-section of a normal circle has a diameter between the maximum diameter and the minimum diameter of the peg to insure a friction fit when the pegs 78 are inserted in the bores 80 (See FIGS. 12, 13, 13A & 14). Alternatively, the bores can have a regular hexagon cross-section and the pegs can have a circular cross-section. Each circumferential end 77 preferably has a step 81. When the two sleeve halves are joined the steps of the opposing sleeve halves create a slot 84 (See FIG. 13). To disassemble the cylindrical sleeve, a flat blade of a screw driver can be inserted into the slot 84 and twisted to pull the pegs 78 out of the bores 80 to separate the sleeve halves.

When the round faceplate 12D is positioned on the front of the cylindrical casing 18A of the latch bolt mechanism 10AA, semi-circular sleeve halves 70 are positioned on the cylindrical casing 18A. The prongs 74 of the horn 72 of each sleeve half are received in the slots 58 of the circumferential flanges 50 of the round faceplate 12D. The slots 58 are longer than the prongs 74. This permits the cylindrical casing 18A to be partially rotated clockwise or counter-clockwise within the cylindrical sleeve 68 when the door latch bolt assembly 10A is fully received in a latch bore of a door. The back wall of each tab 36 has a notch 90 (See FIGS. 16 & 17). When the cylindrical sleeve 68 is assembled on the cylindrical casing 18A, the registration nib 82 on the front of each horn 72 is positioned in notch 90 of a tab 36. This centers the prongs 74 in the slots 58 (See FIGS. 13, 15 & 16). This permits the cylindrical casing to be rotated on the cylindrical sleeve about plus or minus ten degrees. The end of a prong 74 of each sleeve half can engage the end of a slot 58 when the sleeve is rotated far enough. This will stop further rotation of the casing within the sleeve.

The assembled door entry latch bolt assembly 10D (FIG. 18) can be installed in a non-mortised door. The assembly 10D is worked into a one-inch diameter latch bore in the side of a non-mortised door (not shown). The bolt operating mechanism is positioned in the latch bore and the assembly 10D is tapped into the latch bore with a hammer, preferably using a block of wood between the front side of the assembly and the hammer head. The assembly is positioned in an upright position with the horizontal or upright axis 44 of the assembly (See FIGS. 5 and 18 for the upright axis 44) positioned parallel to the faces of the door. Sometimes the assembly will twist or turn when being tapped into the latch bore and not be positioned with the upright axis parallel to the door faces. The assembly may rotate in the latch bore as it is being tapped in because of scoring in the latch bore caused during the drilling operation in forming the bore and/or because of the grain of the wood surrounding the bore. Because the latch bolt mechanism 10AA can be rotated with respect to the cylindrical sleeve 68 to a limited degree, the installer can rotate the latch bore mechanism 10AA after the latch bolt assembly is installed in the door. This is accomplished by placing a square shaft or screw driver in the cam 100 of the bolt operating mechanism 20A (See FIG. 18) and turning the latch bore mechanism 10AA until the assembly is positioned with the upright axis 44 parallel to the door faces.

The invention has been described with respect to the entry latch bolt assembly 1A. However the latch bolt mechanism 10AA can be used in passage and privacy latch bolt assemblies.

Figure 23:
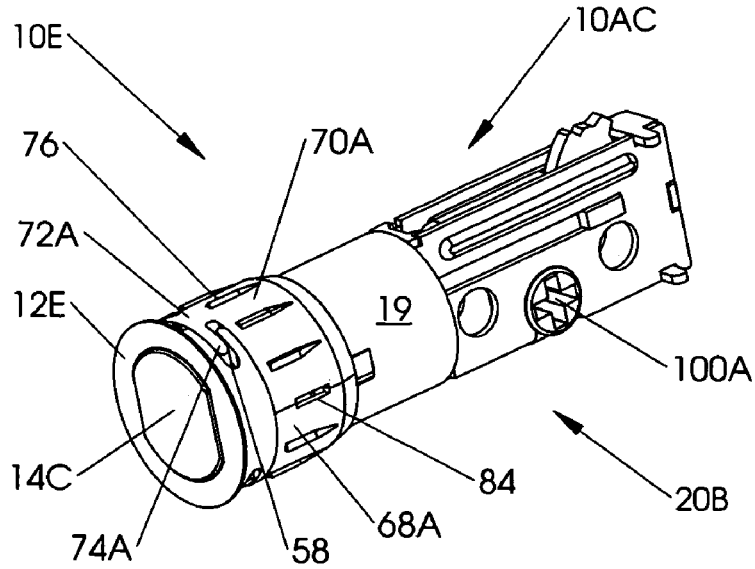
FIG. 23 is a top, front perspective view of an assembled dead latch bolt for a one-inch latch bore of the present invention.
Figure 24:
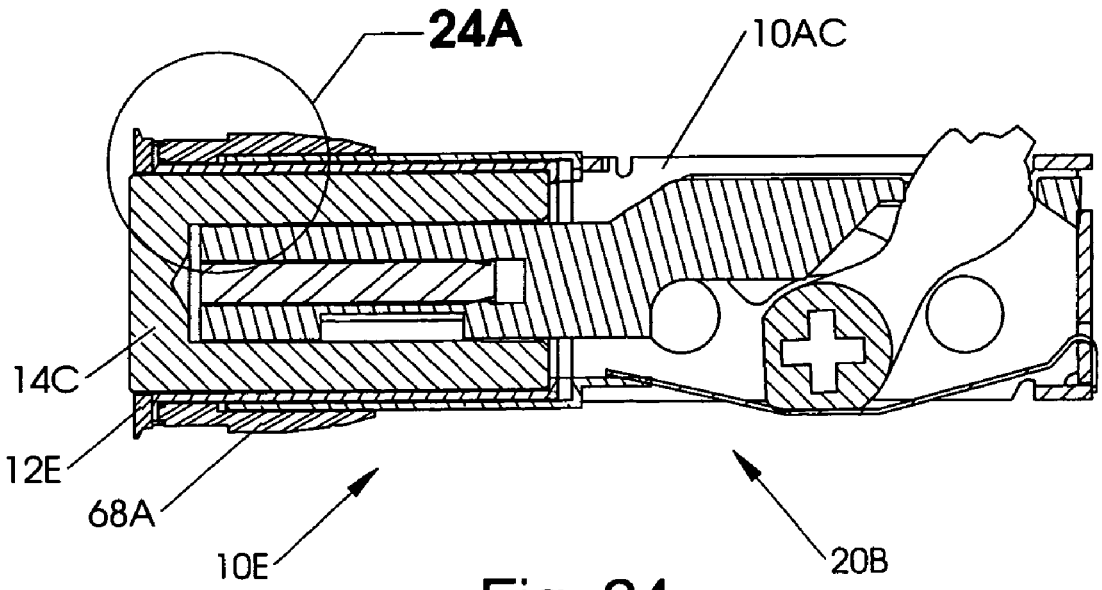
FIG. 24 is a side, cross-sectional view of the dead latch bolt of FIG. 23.
Figure 24A:
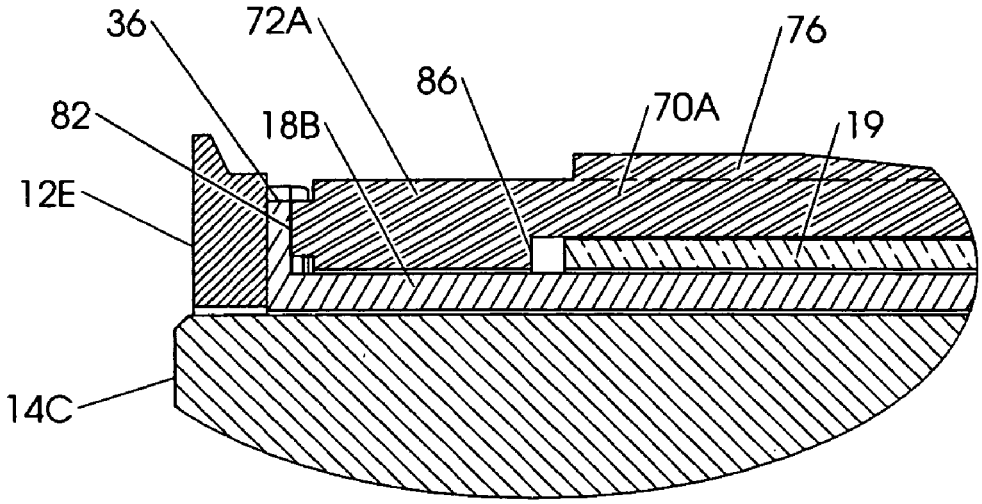
FIG. 24A in an enlarged cross-sectional view of the encircled area 24A of FIG. 24.
Figure 25:
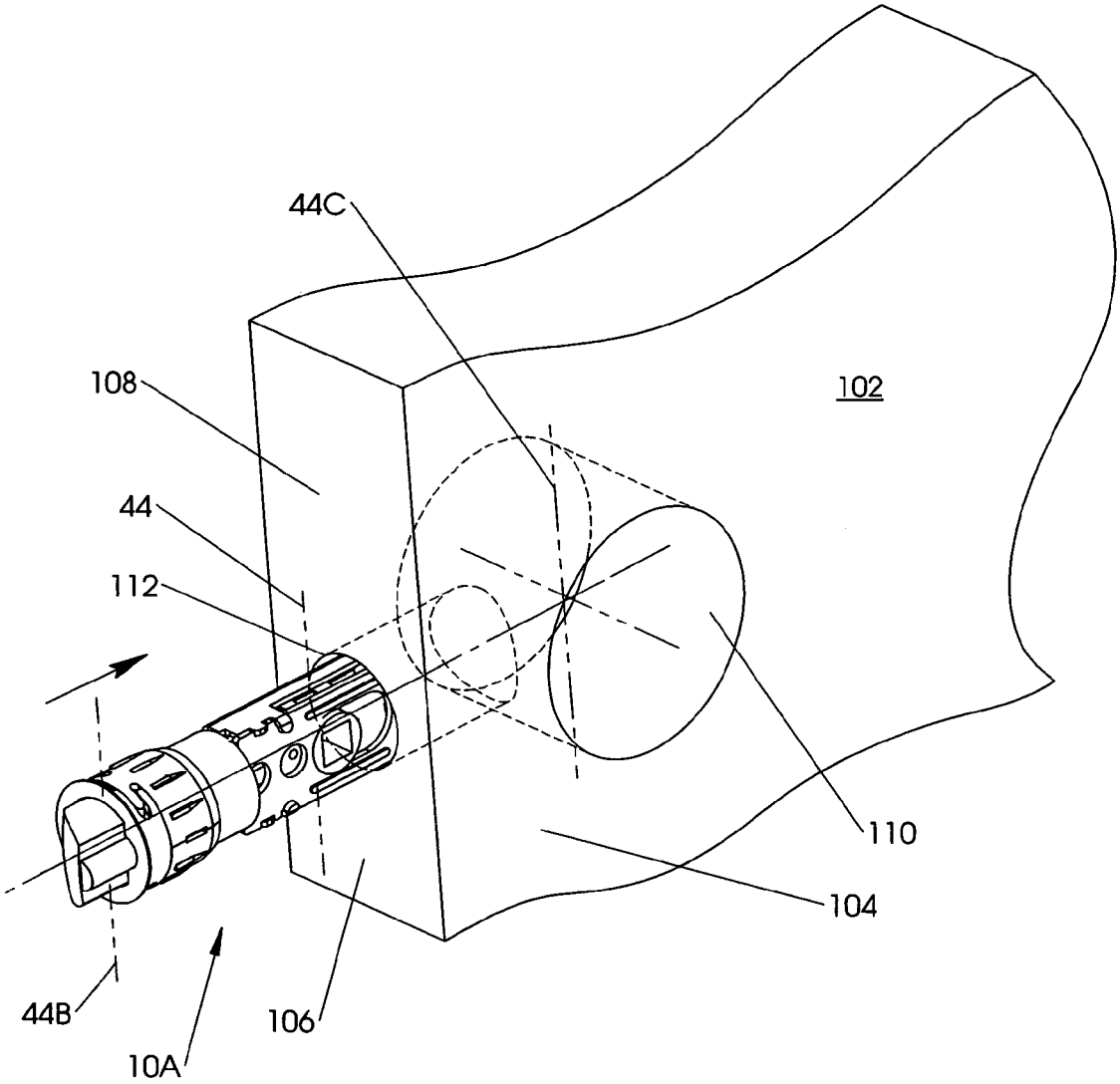
FIG. 25 is a partial top perspective view of the latch side of a door showing installation of the entry latch bolt of FIG. 1A into a one-inch latch bore.

The latch bolt mechanism 10AC (See FIGS. 1C & 1D) for a dead latch bolt assembly is different than the latch bolt mechanism 10AA. However the faceplate 12A and backplate 26 can be secured to the mechanism 10AC as described above for mechanism 10AA and the round faceplate 12D and sleeve halves 70A can be assembled on the latch bolt mechanism 10AC for a dead latch bolt assembly 10AC as equally well as sleeve halves 70A on the latch bolt mechanism 10AC to produce a dead latch bolt assembly (See FIG. 23) for non-mortised doors.

The latch bolt mechanism 10AC has an outer casing 19 surrounding the back portion of the cylindrical casing 18B. Cylindrical casing 18B is rotated, then pushed into the outer casing, and rotated back to set the latch bolt mechanism to a 2⅜ inch backset, or rotated, pulled out of the outer casing and rotated back to set the latch bolt mechanism to a 2¾ inch backset (See FIGS. 1C & 1D). Referring to FIGS. 19 through 24A, the round faceplate 12E is secured on the cylindrical casing 18B of latch bolt mechanism 10AC employing two semi-circular sleeve halves 70A. The semi-circular sleeve halves are detachably joined together to form a full cylindrical sleeve 68A which encircles the front of the cylindrical casing 18B in a manner similar to that described with respect to FIGS. 8 through 17. Each semi-circular sleeve half 70A has a built-up area 86 (FIG. 19) in the front portion of the sleeve half giving an internal diameter slightly larger than the outer diameter of the cylindrical sleeve 18B. The back portion of each sleeve half has an internal diameter slightly larger than the external diameter of the outer casing 19. Sleeve halves 72 and 72A are very similar except sleeve halves 72A have the built-up area 86. Thus each sleeve half 70A has a horn 72A extending from the front side of each sleeve half. Each horn 72A has two prongs 74A extending circumferentially from the horn and a registration nib 82 on the front of the horn. The outer surface of the sleeve halves 70A has a series of parallel ribs 76 circumferentially positioned around the outer surface and extending axially. Each sleeve half has circumferential ends 77. Each end 77 has a peg 78 on its back side. Optionally the peg can be on the front side and the bore on the opposite back side. As with sleeve half 70 described above, the peg 78 can have a normal hexagonal cross-section with a maximum diameter 2*a* measured across the diametrically opposed corners or vertices of the peg and a minimum diameter measured across diametrically opposing flat sides or edges of the peg. The cylindrical bore 80 will have a diameter between the maximum diameter and the minimum diameter of the peg to insure a friction fit when the pegs 78 are inserted in the bores 80 (See FIGS. 12, 13, 13A & 14). Alternatively, the bores can have a regular hexagon cross-section and the pegs can have a circular cross-section. Each circumferential end 77 has a shelf 81. When the two sleeve halves are joined the shelves of the opposing sleeve halves create a slot 84. To disassemble the cylindrical sleeve 68A, a flat blade of a screw driver can be inserted into the slot 84 and twisted to pull the pegs 78 out of the bores 80 to separate the sleeve halves (see FIGS. 13 & 18).

The cylindrical casing 18B on the latch bolt mechanism 10AC is rotatably and slidably positioned within the outer sleeve casing 19. As described above when the backset for the dead latch bolt assembly is to be 2⅜ inches, the cylindrical casing 18B is rotated and slid into the outer sleeve casing. In the FIGS. 20-24A, the dead latch bolt assembly backset is 2¾ inches. Thus the diameter of the cylindrical casing 18B is less than the outer diameter of the outer casing 19 and the sleeve 68A must accommodate for this diameter difference (see FIGS. 24 & 24A). The inner surface of the back portion of the cylindrical sleeve 68 is supported on the outer casing sleeve 19. The inner surface, i.e., the built-up area 86, of the front portion of the cylindrical sleeve built-up portion is supported on the outer surface of the cylindrical casing 18B (See FIGS. 24 & 24A).

The inner diameter of the space between the circumferential flanges is slightly larger than the outer diameter of the cylindrical casing 18B. When the round faceplate 12E is positioned on the front of the cylindrical casing 18B, the inner sides of the flanges 50 are supported on the outer sides of the cylindrical casing 18B. The round faceplate 12E is positioned on the front of the cylindrical casing 18B in the same manner the round faceplate 12D is positioned on cylindrical casing 18A described above. The tabs 36 on the cylindrical sleeve 18B are received within tab receivers 60 of the round faceplate. Semi-circular sleeve halves 70A are positioned on the cylindrical casing 18B. The prongs 74A of the horn 72A of each sleeve half 70A is received in the slots 58 of the circumferential flanges 50 of the round faceplate 12E. The slots 58 are longer than the prongs 74A. This permits the cylindrical casing 18B and the outer casing 19 to be partially rotated clockwise or counter-clockwise within the cylindrical sleeve 68A. The back wall of each tab 36 has a notch 90 (See FIG. 17). When the cylindrical sleeve 68 is assembled on the cylindrical casing 18A, the registration nib 82 on the front of each horn 72A is positioned in notch 90 of a tab 36. This centers the prongs 74A in the slots 58 (See FIGS. 13, 15 & 16). This permits the latch bolt mechanism 10AC to be rotated. Preferably the latch bolt assembly can be rotated up to about ten degrees in either direction.

The assembled door latch dead bolt assembly 10C (FIG. 18) is ready to be installed in a non-mortised door. The assembly is worked or slid or urged into a one-inch diameter latch bore in the side of a non-mortised door (not shown). The bolt operating mechanism is positioned in the latch bore and the assembly is tapped into the latch bore with a hammer, preferably using a block of wood between the front side of the assembly and the hammer head. The assembly is positioned in an upright position with the horizontal or upright axis 44 of the assembly (See FIGS. 5 and 18 for the upright axis 44) positioned parallel to the faces of the door. Sometimes the assembly will not be positioned in the upright axis after insertion into the latch bore. Because the latch bolt mechanism 10AC can be rotated with respect to the cylindrical sleeve 68A, the installer can rotate the latch bore mechanism 10AC after the door latch deadbolt assembly 10C is installed in the door. This is accomplished by placing a square shaft or screw driver in the cam 100 of the bolt operating mechanism 20B and turning the latch bore mechanism 10AC until the assembly is positioned with its upright axis (not shown) parallel to the door faces.

The invention has been described with respect to the entry latch bolt assembly 1A. However, the latch bolt mechanism 10AA can be used in passage and privacy latch bolt assemblies.

The latch bolt mechanism 10AC (See FIGS. 1C & 1D) for a dead latch bolt assembly is different than the latch bolt mechanism 10AA. However a faceplate and a backplate can be secured to the latch bolt mechanism 10AC in the same manner as a faceplate and backplate can be secured to the latch bolt mechanism 10AA as described above. The round faceplate 12E and sleeve halves 70A can be assembled on the latch bolt mechanism 10AC (see FIGS. 20-24A) in the same manner as round faceplate 12D and sleeve halves 70 on the latch bolt mechanism 10AA (see FIGS. 9-11, 13, 15 & 16).

The diameter of the cylindrical casing 18A and the outer cylindrical casing 19 are about ⅞-inch. If the bolt operating mechanism 20A or 20B can be received in a ⅞-inch latch bore, then the entire door latch assembly can be received in a ⅞-inch latch bore. In this situation the latch bolt assembly must employ a faceplate and backplate and be used for mortised doors because there is insufficient room to employ a sleeve to join a round face plate to the latch bolt assembly.

One of the advantages of the present invention is that the latch bolt mechanism 10AA or 10AC can be used for mortised type door latch bolt assemblies (10A, 10B, and 10C) for mortised doors, and it can also be used for door latch bolt assemblies (10D & 10E) for non-mortised doors.

What is claimed is:

1. A latch bolt comprising:

a cylindrical casing having a front end, a back end and an external surface, and at least one tab extending radially outward from the front end of the cylindrical casing;

a bolt adapted to slide in or out of the cylindrical casing;

a bolt operating mechanism fixed to the rear of the cylindrical casing and adapted to slide the bolt in and out of the cylindrical casing;

a faceplate having front side and back side and a bolt opening adapted to receive the bolt in a sliding relationship, the faceplate having two opposing semi-circular flanges extending axially from the back side, each flange having two circumferential ends and a slot with an open end and a closed end in each of the semi-circular flanges' circumferential ends; and a cylindrical sleeve comprising two semi-circular sleeve halves joined together, the cylindrical sleeve turnably received on the external surface of the cylindrical casing at the front end of the cylindrical casing with each tab of the cylindrical casing positioned against the back side of the faceplate, each semi-circular half having a horn with opposing prongs extending circumferentially on its front side, each prong adapted to be slidably received in one of the slots in the flanges and to capture each tab between the back side of the faceplate and a horn of one of the semi-circular halves to secure the faceplate to the front end of the cylindrical casing.

2. The latch bolt according to claim 1 wherein the cylindrical casing has two opposing tabs extending radially outward from the front end.

3. The latch bolt according to claim 1 wherein a tab receiver is formed between the circumferential ends of the flanges and the backside of the faceplate, each tab receiver adapted to receive a tab.

4. The latch bolt according to claim 1 wherein arcuate ribs extend radially outward from the backside of the faceplate and bridge the circumferential ends of the flanges, and a tab receiver is formed between the circumferential ends of the flanges and each rib, each tab receiver adapted to receive a tab.

5. The latch bolt according to claim 1 wherein the slots are longer than the prongs permitting the cylindrical casing and the faceplate to be turned at least about ten degrees in each direction with respect to the cylindrical sleeve.

6. The latch bolt according to claim 5 wherein at least one of the tabs has a v-notch on its backside, and the semi-circular sleeve half opposite the tab has a v-nib on its front side adapted to engage the v-notch to register the prongs received in the slots equal distance from the closed end of the slots.

7. The latch bolt according to claim 5 wherein each tab has a v-notch on its backside, and each semi-circular sleeve half opposite each tab has a v-nib on its front side adapted to engage the v-notch of the tab to register the prongs received in the slots equal distance from the closed end of the slots.

8. The latch bolt according to claim 1 wherein each semi-circular sleeve half has at least one peg extending circumferentially from one circumferential end of the sleeve semi-circular half and a bore extending tangentially into the other circumferential end of the semi-circular sleeve half, the pegs of each sleeve semi-circular half in registration with the bore of the other sleeve semi-circular half, the peg of each semi-circular sleeve half adapted to be received in the bore of the other semi-circular sleeve half.

9. a latch bolt comprising:

a cylindrical casing having a front end, a back end and an external surface, and at least two opposing tabs extending radially outward from the front end of the cylindrical casing;

a bolt adapted to slide in or out of the cylindrical casing;

a bolt operating mechanism fixed to the rear of the cylindrical casing and adapted to slide the bolt in and out of the cylindrical casing;

a faceplate having front side and back side and a bolt opening adapted to receive the bolt in a sliding relationship, the faceplate having two opposing semi-circular flanges extending axially from the back side, each flange having two circumferential ends and a slot with an open end and a closed end in each of the semi-circular flanges' circumferential ends, and a slot formed between the circumferential ends of the flanges and the back side of the faceplate, each slot adapted to receive a tab; and a cylindrical sleeve comprising two semi-circular sleeve halves joined together, the cylindrical sleeve turnably received on the external surface of the cylindrical casing at the front end of the cylindrical casing with each tab of the cylindrical casing positioned against the back side of the faceplate, each semi-circular half having a horn with opposing prongs extending circumferentially on its front side, each prong adapted to be slidably received in one of the slots in the flanges and to capture each tab between the back side of the faceplate and a horn of one of the semi-circular halves to secure the faceplate to the front end of the cylindrical casing.

10. The latch bolt according to claim 9 wherein the slots are longer than the prongs permitting the cylindrical casing and the faceplate to be turned up to about ten degrees in each direction within the cylindrical sleeve.

11. The latch bolt according to claim 10 wherein at least one of the tabs has a v-notch on its backside, and the semi-circular sleeve half opposite the tab has a v-nib on its front side adapted to engage the v-notch to register the prongs received in the slots equal distance from the closed end of the slots.

12. The latch bolt according to claim 10 wherein each tab has a v-notch on its backside, and each semi-circular sleeve half opposite each tab has a v-nib on its front side adapted to engage the v-notch of the tab to register the prongs received in the slots equal distance from the closed end of the slots.

13. The latch bolt according to claim 9 wherein each semi-circular sleeve half has at least one peg extending circumferentially from one circumferential end of the semi-circular sleeve half and a bore extending tangentially into the other circumferential end of the semi-circular sleeve half, the pegs of each sleeve semi-circular half in registration with the bore of the other semi-circular sleeve half, the peg of each semi-circular sleeve halve adapted to be received in the bore of the other semi-circular sleeve half.

14. a latch bolt comprising:

a cylindrical casing having a front end, a back end and an external surface, and at least two opposing tabs extending radially outward from the front end of the cylindrical casing;

a bolt adapted to slide in or out of the cylindrical casing;

a bolt operating mechanism fixed to the rear of the cylindrical casing and adapted to slide the bolt in and out of the cylindrical casing;

a faceplate having front side and back side and a bolt opening adapted to receive the bolt in a sliding relationship, the faceplate having two opposing semi-circular flanges extending axially from the back side, each flange having two circumferential ends and a slot with an open end and a closed end in each of the semi-circular flanges' circumferential ends, the faceplate having arcuate ribs extending radially outward from the backside of the faceplate and bridging the circumferential ends of the flanges, and a slot formed between the circumferential ends of the flanges and each rib, each slot adapted to receive a tab; and a cylindrical sleeve comprising two semi-circular sleeve halves joined together, the cylindrical sleeve turnably received on the external surface of the cylindrical casing at the front end of the cylindrical casing with each tab of the cylindrical casing positioned against the back side of the faceplate, each semi-circular half having a horn with opposing prongs extending circumferentially on its front side, each prong adapted to be slidably received in one of the slots in the flanges and to capture each tab between the back side of the faceplate and a horn of one of the semi-circular halves to secure the faceplate to the front end of the cylindrical casing, the slots are longer than the prongs permitting the cylindrical casing and the faceplate to be turned up to about ten degrees in each direction with respect to the cylindrical sleeve.

15. The latch bolt according to claim 14 wherein at least one of the tabs has a v-notch on its backside, and the semi-circular sleeve half opposite the tab has a v-nib on its front side adapted to engage the v-notch to register the prongs received in the slots equal distance from the closed end of the slots.

16. The latch bolt according to claim 14 wherein each tab has a v-notch on its backside, and each semi-circular sleeve half opposite each tab has a v-nib on its front side adapted to engage the v-notch of the tab to register the prongs received in the slots equal distance from the closed end of the slots.

17. The latch bolt according to claim 14 wherein each semi-circular sleeve half has at least one peg extending circumferentially from one circumferential end of the semi-circular sleeve half and a bore extending tangentially into the other circumferential end of the sleeve semi-circular half, the pegs of each semi-circular sleeve half in registration with the bore of the other semi-circular sleeve half, the peg of each semi-circular sleeve halve adapted to be received in the bore of the other semi-circular sleeve half.

18. a latch bolt comprising:

a cylindrical casing having a front end, a back end and an external surface, and two opposing tabs extending radially outward from the front end of the cylindrical casing, each tab having a back side and a v-notch on its back side;

a bolt adapted to slide in or out of the cylindrical casing;

a bolt operating mechanism fixed to the rear of the cylindrical casing and adapted to slide the bolt in and out of the cylindrical casing;

a faceplate having front side and back side and a bolt opening adapted to receive the bolt in a sliding relationship, the faceplate having two opposing semi-circular flanges extending axially from the back side, each flange having two circumferential ends and a slot with an open end and a closed end in each of the semi-circular flanges' circumferential ends, the faceplate having arcuate ribs extending radially outward from the backside of the faceplate and bridging the circumferential ends of the flanges, and a slot formed between the circumferential ends of the flanges and each rib, each slot adapted to receive a tab; and a cylindrical sleeve comprising two semi-circular sleeve halves joined together, the cylindrical sleeve turnably received on the external surface of the cylindrical casing at the front end of the cylindrical casing with each tab of the cylindrical casing positioned against the back side of the faceplate, each semi-circular sleeve half having a horn with opposing prongs extending circumferentially on its front side, each prong adapted to be slidably received in one of the slots in the flanges and to capture each tab between the back side of the faceplate and a horn of one of the semi-circular sleeve halves to secure the faceplate to the front end of the cylindrical casing, the slots are longer than the prongs permitting the cylindrical casing and the faceplate to be turned up to about ten degrees in each direction with respect to the cylindrical sleeve, and each semi-circular sleeve half opposite each tab has a v-nib on its front side adapted to engage the v-notch of the tab to register the prongs received in the slots equal distance from the closed end of the slots.

19. The latch bolt according to claim 18 wherein each semi-circular sleeve half has at least one peg extending circumferentially from one circumferential end of the semi-circular sleeve half and a bore extending tangentially into the other circumferential end of the sleeve semi-circular half, the pegs of each semi-circular sleeve half in registration with the bore of the other semi-circular sleeve half, the peg of each semi-circular sleeve half adapted to be received in the bore of the other semi-circular sleeve half.

* * * * *